US005954059A

United States Patent [19]

Beven et al.

[11] Patent Number: 5,954,059

[45] Date of Patent: Sep. 21, 1999

[54] FILTRATION MATERIALS

[75] Inventors: John Lawson Beven; Paul David Case; Martin Coleman, all of Southampton; Colin Campbell Greig, Redlynch; Peter Rex White, Romsey, all of United Kingdom

[73] Assignee: British-American Tobacco Company Limited, Middlesex, United Kingdom

[21] Appl. No.: 08/208,013

[22] Filed: Mar. 8, 1994

[30] Foreign Application Priority Data

Mar. 12, 1993 [GB] United Kingdom ..... 9305066

[51] Int. Cl.[6] ..... A24D 3/00; A24D 3/08; A24D 3/14; A24D 3/16

[52] U.S. Cl. ..... 131/332; 521/81

[58] Field of Search ..... 131/331, 332, 131/339, 340, 345; 521/81

[56] References Cited

U.S. PATENT DOCUMENTS

| | | | |
|---|---|---|---|
| 2,806,474 | 9/1957 | Yarsely | 131/345 |
| 4,088,628 | 5/1978 | Bernstein et al. | 428/516 |
| 4,756,316 | 7/1988 | Keritsis et al. | 131/94 |
| 5,153,037 | 10/1992 | Altieri | 428/35.6 |
| 5,272,181 | 12/1993 | Boehmer et al. | 521/84.1 |
| 5,288,318 | 2/1994 | Mayer et al. | 106/213 |
| 5,308,879 | 5/1994 | Akamatu et al. | 521/84.1 |
| 5,497,793 | 3/1996 | Kubica | 131/331 |
| 5,523,036 | 6/1996 | Luke et al. | 264/45.3 |

*Primary Examiner*—Jeffrey Mullis
*Attorney, Agent, or Firm*—Kane, Dalsimer, Sullivan, Kurucz, Levy, Eisele and Richard

[57] ABSTRACT

An extruded filtration material which is degradable and comprises either a plastics material or an inorganic material having a melting point above the operating temperature, a polysaccharide expansion medium, a binder and water. These ingredients are fed to an extruder and subjected to an extrusion process which involves a pressure reduction, upon extrusion from the exit die, of up to about 70 bars so that swelling of the extrudate occurs to give a cellular structure. When exposed to the natural weather conditions, tobacco smoke filter elements comprising such material degrade without leaving a fused amalgamation of plastics or inorganic material.

2 Claims, 13 Drawing Sheets

FILTRATION MATERIALS

BACKGROUND OF THE INVENTION

1. Field of the Invention

This invention relates to filters and filtration material, and in particular, but not exclusively to tobacco smoke filters, and methods of producing same.

2. Brief Description of Related Art

Numerous methods of making filtration material have been proposed. One method previously proposed by the Applicant was disclosed in British Patent Specification No. 2 205 102A, wherein a particulate plastics material, a polysaccharide, optionally a binder, and water are fed to an extruder which is operated under such heat and pressure conditions that upon emergence from the extruder die, the extrudate assumes a cross-section greater than that of the exit orifice of the die. The expanded product may be fed to the garniture of a cigarette filter making machine or shredded and then gathered and formed into a cigarette filter in a garniture of a cigarette filter making machine. A disadvantage with the product obtained by following the teaching in this document was that, although the product was considerably expanded, it was not very suitable for standard filter making product because at low moisture contents the product could be friable and brittle. Thus, the use of such product on a filter tipping machine, where the filter element is rolled to interattach same to the tobacco rod, would be likely to result in the physical breakage thereof. Furthermore, it has been found that polypropylene, and other plastics materials having similar melting points, fuse with itself and/or the polysaccharide expansion medium and will not break down if left in the physical environment without leaving a fused amalgamation of plastics material.

SUMMARY OF THE INVENTION

The present invention has as an object the provision of processes for producing a filtration product which is particularly suitable for filtering tobacco smoke and which is degradable, especially under the weather conditions of the natural environment.

It is a further object of the present invention to provide a filtration product which has physical characteristics which are suitable for the manufacture of tobacco smoke filtration elements and filter tipped cigarettes, and which is degradable, especially under the weather conditions of the natural environment.

The weather conditions of the natural environment were simulated using a Q.U.V. Weathering Tester (Horizontal Option) made by the Q—Panel Company. This machine reproduces the damage caused by sunlight, rain and dew on materials placed outdoors. Filters according to the present invention and control conventional filter elements of cellulose acetate and paper were tested by exposing samples for pre-determined time periods to alternating cycles of UV light and moisture, at controlled elevated temperatures. The conditions of the cycles were:

1. 8 hours UV light at 60° C.
2. 0.5 hours "rain" at room temperature.
3. 3.5 hours condensation at 50° C.

The present invention provides an extruded filtration material comprising plastics material, a water-soluble polysaccharide expansion medium, a binder and water, the melting point of the plastics material being greater than the operating temperature at the operating conditions of the extrusion process, wherein the extruded filtration material is degradable.

The term 'degradable' as used herein means that all water soluble or water dispersible components are dissolved or dispersed and the non-water soluble or non-water dispersible components do not form a fused or melted amalgamation. There is a change in physical form, the strength and shape of the extrudate being lost due to the effects of water and/or sunlight.

As used herein the term 'water-soluble' as applied to the polysaccharide expansion medium means a compound which goes into solution (fully or partially), or forms a suspension in water. The water-soluble polysaccharide medium may alternatively be defined as a water-suspendable polysaccharide medium. The medium in the final extruded product should also absorb water causing disintegration of the product structure because of the properties of the medium.

As used herein the term 'extruded' relates to any process where material is extruded through an orifice, under pressure or not, into conditions which subject the extruded material to a reduction in pressure. Suitably the reduction in pressure ranges from a 15 bar reduction to a 70 bar reduction upon exit from the orifice, although when sugar as a plasticiser is utilised, the pressure difference may be up to 170 bars. The pressure reduction may be achieved by extrusion into a vacuum.

DETAILED DESCRIPTION OF THE PREFERRED EMBODIMENTS OF THE INVENTION

Figure 1:
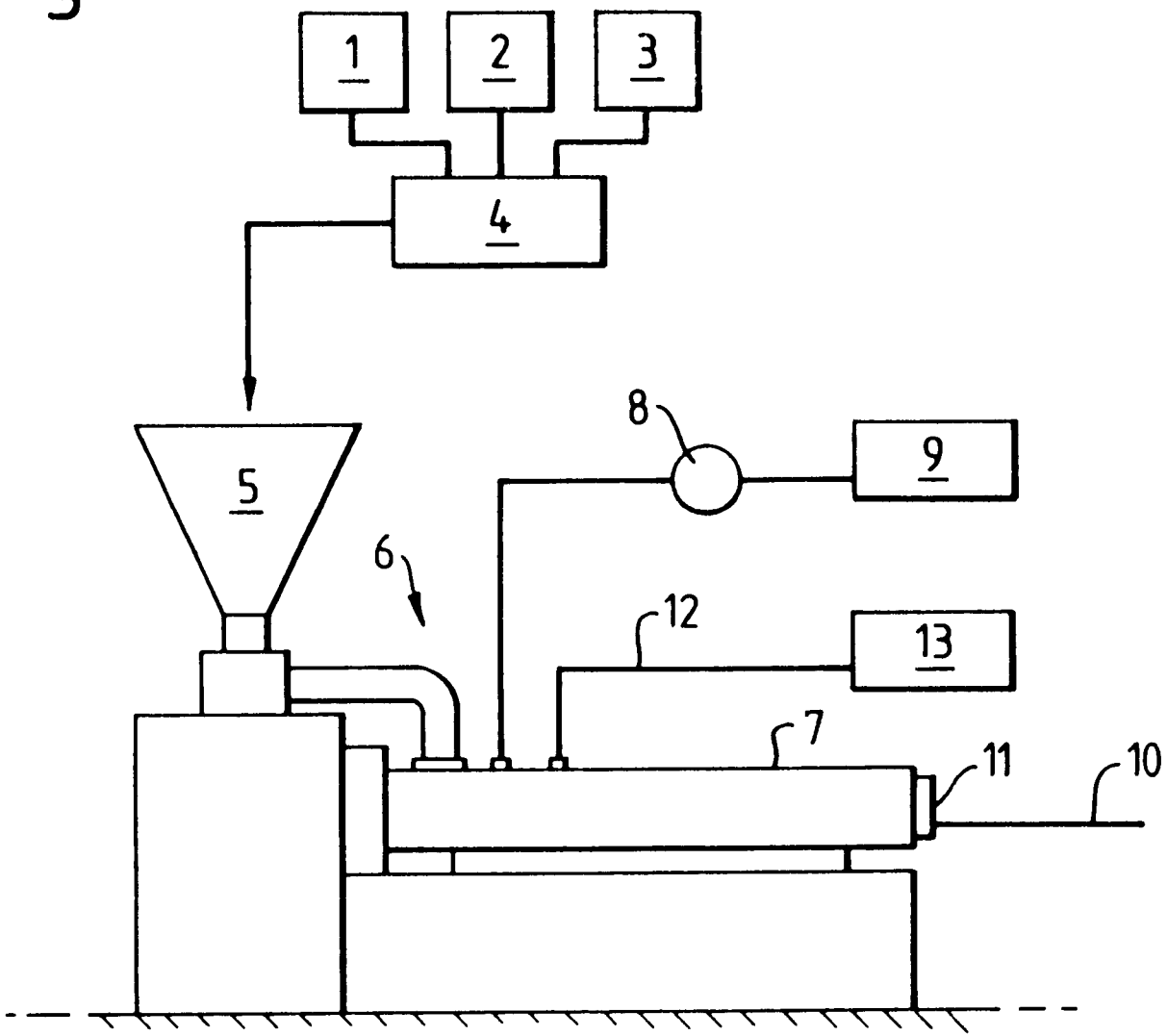
FIG. 1 shows apparatus for carrying out the method of the invention.

The present invention further provides an extruded filtration material comprising inorganic material, a water-soluble polysaccharide expansion medium, a binder and water, wherein the filtration material is degradable.

The present invention provides a process of making an extruded filtration material, wherein plastics material, water-soluble polysaccharide expansion medium, binder and water are mixed together, and extruded through the exit orifice of an extruder die, the plastics material being selected so that the melting point thereof is above the operating temperature of the extrusion process at any particular operating pressure, wherein the extruded product is cellular and is degradable.

The present invention further provides a process of making an extruded filtration material, wherein inorganic material, water-soluble polysaccharide expansion medium, binder and water are mixed together, and extruded through the exit orifice of an extruder die, the inorganic material being selected so that the melting point thereof is above the operating temperature of the extrusion process at any particular operating pressure, wherein the extruded product is cellular and is degradable.

Preferably extrusion occurs under pressures at the extruder die above atmospheric pressure. Alternatively extrusion may occur at substantially atmospheric pressure into a vacuum, for example, injection moulding.

The present invention also provides a degradable smoking article comprising a degradable smoking material enwrapped in degradable wrapping material and a degradable filter comprising extruded filtration material enwrapped in degradable wrapping material, said filtration material comprising 0–90% plastics material, 5–100% water-soluble polysaccharide expansion medium and 0–50% binder, all on a dry weight basis of the extruded filtration material and produced in accordance with the above method.

Preferably the filtration material is a tobacco smoke filtration material.

Preferably the plastics material is one or more of the group consisting of cellulose acetate, polypropylene, polyethylene or polystyrene. The term plastics material as used herein includes man-made fibres or materials natural or otherwise which can exhibit plastic properties, for example, cellulose acetate. The material selected will depend on the process of manufacture of the filtration material and the operating conditions of that process. If cellulose acetate is used, preferably the cellulose acetate is cellulose acetate flake. The maximum particle size of the plastics material is naturally governed by the extruder configuration. A range of particle size from <75 $\mu$→500 $\mu$was utilised.

Suitably the cellulose acetate flake is of the same grade, i.e. purity and degree of substitution, as that supplied for producing conventional cellulose acetate tow.

The inorganic material may suitably be mineral earth materials, such as vermiculite and alumina, or materials such as carbon, aluminium hydroxide or chalk. Materials such as Metaspheres 50, aluminosilicates, such as Garolite, and Trihyde may also be used. Garolite is a trade name of Croxton & Garry, Dorking for an inert low density filler of hollow silicate glass spheres. Metaspheres 50 is a Trade Name of Phillite Ltd. Trihyde is a Trade Name of Croxton & Garry, Dorking for alumina trilydrate. Preferably the inorganic materials are of particulate form. Mixtures of these compounds may also be used.

The expansion medium is preferably starch, which may be natural starch, such as maize starch, having a higher proportion of amylopectin rather than amylose, or a starch having a higher proportion of amylose, such as, for example, Hylon (VII) (Registered Trade Mark) as sold by National Starch and Chemical Company. Rice or tapioca starch may also be used. Chemically modified starch, such as hydroxypropyl amylose sold under the Registered Trade Mark of Ecofoam, for example, may also be used, provided it is water-soluble to a sufficient degree. Chemically modified starches such as acid hydrolysed or enzyme hydrolysed starches may also be suitable. Suitably the starch is a food-grade starch. Mixtures of starches may also be used. Mixtures of expansion medium may also be used.

The binder material is preferably a cellulosic binder such as hydroxyethylcellulose, hydroxypropyl cellulose in particular, or a carboxymethyl cellulose, such as sodium carboxymethyl cellulose. Pectins and alginates or other similar water-soluble binders can also be used. Mixtures of binders may also be used.

In an extrusion process, preferably 0–90% plastics material, 0–100% polysaccharide material and 0–50% binder is fed to the extruder on a dry weight basis of the materials fed to the extruder. Water may account, on a weight basis, for 1–35%, preferably 1–30%, more preferably 1–25%, and even more preferably 5–20%, of the materials plus water fed to the extruder. Where 0% is given above, that component should be seen to be an optional component.

Where plastics material is desired to be extruded in a degradable form in accordance with the invention, the plastics material is suitably present in the range of 50–90% on a dry weight basis. The polysaccharide expansion medium in this instance is suitably present within the range of 1–50% by weight and 1–20% binder by weight.

However, we have found that in order to reduce costs and to provide a filtration material which is more degradable, or at least degradable to natural products, the amount of plastics material may be reduced, even down to zero. The proportions of polysaccharide material consequently can be increased above the 50% level, even up to constituting 100% of the dry materials fed to the extruder, i.e. starch alone may be the dry material. A plasticiser may be advantageously utilised, particularly in the latter embodiment. In all of the embodiments listed herein, the presence of a plasticiser serves to give resiliency to the extrudate, which is particularly useful in processing of the extrudate. Thus, the plastics material may suitably be present in the range 0–50%, the polysaccharide expansion medium in the range of 50–100, and 0–50% binder, all weights given on a dry weight basis of the materials fed to the extruder.

Optionally, 0–25% of the materials fed to the extruder on a dry weight basis of a plasticiser, such as glycerol, a sugar or a humectant, may be utilised. Preferably 0–20%, more preferably 0–15% and even more preferably 0–10% of a plasticiser may be utilised, depending on the requirements of the product.

Advantageously, in one embodiment currently being used the plastics material is present at about 80% by weight, the polysaccharide is present at about 15% by weight and the binder is present at about 5% by weight, of the dry materials fed to the extruder. The water fed to the extruder in this formulation is preferably in a range of 8–20%, and preferably in the range of 10–15% by weight of the total material, including water, fed to the extruder, depending on the product characteristics required.

In alternative embodiments of the inventive concept, the formulation comprises plastics material within the range of 55–75%, polysaccharide material within the range of 20–35% and binder material within the range of 5–15% on a dry weight basis of the materials fed to the extruder. The water fed to the extruder may suitably be within the range of 8–20%, and is preferably within the range of 10–15% by weight of the total material, including water, fed to the extruder.

In further alternative embodiments of the inventive concept the formulation may comprise plastics material within the range of 65–95%, polysaccharide material within the range of 1–35% and binder material within the range of 1–15% on a dry weight basis of the materials fed to the extruder. The water fed to the extruder may suitably be within the range of 8–15% by weight of the total material, including water, fed to the extruder.

In yet further embodiments of the inventive concept the formulation may comprise 0–50% plastics material, 50–100% polysaccharide material and 0–50% binder material, by weight of the dry materials fed to the extruder, and water is within the range of 5–50% by weight of the total materials, including water, fed to the extruder.

Suitably the barrel of the extruder has a temperature profile ranging from the feed port, or first section, temperature of less than 65° C., a second section having a temperature of 65° C., a third section having a temperature of 85° C., and a die end, or fourth section, having a temperature of 115° C. The temperature of the extrudate at the die is suitably therefore in excess of 100° C. Extrudate temperatures at the die may, however, range from 50° C. to 200° C. Naturally the temperature at the die will depend on the plastics material fed to the extruder, the melting point thereof, and the physical requirements of the produced filtration material.

The operating pressure of, as well as the torque and current drawn by, the extruder depends on the material and the formulation of the material running therethrough, the screw speed, the screw configuration, the amount of water in the mixture within the barrel, the feed rate and the die size, for example. The exact operating conditions will therefore be dependent on the material formulation, the extruder configuration and the characteristics of the product required upon extrusion. These can be readily determined by the skilled man without the exercise of inventive ingenuity.

The purpose of introducing water to the extruder is to produce the foamed structure of the extrudate. In the extruder the materials fed thereto are subjected to conditions of heat, shear and pressure such that immediately upon emergence from the exit die of the extruder, the water, or at least a portion thereof, vaporises into steam, thereby creating cells within the extrudate and a consequent swelling of the extrudate. The water may be injected into the extruder through ports in the extruder barrel and/or be fed to the extruder via the feed hopper thereof.

The cellular structure produced by the vaporisation of water at emergence from the exit die of the extruder preferably provides a porous structure for the passage of air and/or smoke. The cellular structure may comprise a proportion of closed cells and a proportion of cells which are inter-connected or open, provided that there is sufficient inter-connection of cells along the length of the extrudate to provide an acceptable pressure drop along a cut portion of the extrudate. The pressure drop can be measured, for example, when a cut portion of the extrudate is placed in a pressure drop testing machine. Pressure drop measurement is an indication of the resistance to air as air is drawn along the length of a cut portion of extrudate.

Preferably the filtration material is extruded as a rod of filtration material, for example, by extrusion to atmospheric pressure through a circular die. For filtration material for use as tobacco smoke filter material this is particularly advantageous, as the arrangement approximates conventional filter rod appearance. The size and characteristics of the rod can also be controlled. Alternatively, the extrudate may take the form of a sheet which may then be cut into shreds and fed through a chimney to the garniture of a cigarette making machine, for example. In a further alternative, the extrudate may be extruded under vacuum into a tubular mould.

The present invention provides a tobacco smoke filter element comprising a rod of extruded filtration material, the rod of filtration material being degradable and being produced in accordance with the method hereof.

On an experimental scale extruder, a Clextral BC21, for example, the die diameter may be from about 2.5–10 mm. The expanded extrudate issuing from the die may then be sized and shaped to a conventional or required rod diameter. The preferred die size for production purposes may readily be determined upon scaling up of the experimental design to full size.

The composition of the extruded filtration material will be similar to the composition of the materials fed to the extruder because of the closed system of operation. The final product composition will depend on the moisture conditions under which measurement of the product is carried out.

The moisture content of the extrudate exit the die is typically within the range of about 5% to about 35%. The density of the final product after extrusion may be within the range 100 mg/cc–560 mg/cc. Advantageously, the density of the final product is within the range of 100 mg/cc–400 mg/cc, and preferably within the range of 125 mg/cc–300 mg/cc. Rods of filtration material can be produced according to the inventive method, with densities which are similar to conventional filter rod densities. Naturally, the density of the final product is dependent on the original formulation fed to the extruder, the operating conditions of the extruder and the method by which the extrudate is handled after extrusion.

Extruded rods of filtration material according to the present invention, when wrapped in a wrapper, may be laser ventilated to vary the delivery of tobacco smoke when the rod is attached to a rod of smoking material. The surface of the extruded rod is suitably perforated by the laser treatment. Porous plugwrap may also be used.

It has been observed that the filtration efficiency of extruded filtration material can be substantially constant over a pressure drop range of 30–120 mm W.G. per 20 mm length of rod. This feature is surprising and is not seen in conventional rods of filtration material.

It has also been observed that cut rods of extruded filtration material, when exposed to the natural environment, rapidly begin to disintegrate in the weathering tester within the equivalent of what would be 24 hours of exposure to the natural environment. This feature is not exhibited by conventional cellulose acetate filter rods.

Rods according to the present invention also exhibit a rod pressure drop within the range of 100 mm WG–7000 mm WG for a 100 mm length. This pressure drop range is considerably wider than that which is obtainable from conventional cellulose acetate filter rods. A large pressure drop range can be advantageous in terms of providing a large scope for reduction, for example, in the pressure drop range consequent of further processing techniques of the extruded rod downstream of the die.

The pressure drop measurement taken on most of the samples described herein is the pressure drop of the samples without downstream processing exit the die, other than collection by hand in a tray as long rods.

Rods extruded according to the present invention have been found to exhibit a firmness which may be at least about 10% greater than the firmness of rods made of conventional cellulose acetate tow. Applicant has found that it is, however, possible to achieve firmness values which are closer to the firmness values of conventional cellulose acetate filter rods by varying the formulation fed to the extruder. Applicant currently believes that adjustment of the extruder operating conditions gives a lesser effect on firmness than does variation in the formulation.

Extruded rod may also comprise a photodegradable substance which promotes degradation in sunlight.

In Examples 1, 2, 3 and 6 the same plastics, polysaccharide and binder blend was utilised, this being a blend of 80% cellulose acetate flake, 15% starch and 5% hydroxy propyl cellulose. As shown in FIG. 1, each component may be fed from supply bins 1, 2, 3 to a blending bin 4. The blended components were fed via a K-tron feeder 5 to a Clextral BC21 extruder 6 having a barrel 7 comprising four 100 mm barrel sections and a length to diameter ratio of 16:1. The feed port, or first section, of the extruder barrel had been modified and it was not possible to control the temperature of that particular section of the extruder barrel. Water was injected via a pump 8 from a supply source 9 into the barrel section immediately downstream of the feed port. The extruded product 10 was collected by hand immediately exit the extruder die 11 and collected in a long tray.

A plasticiser, sugar or humectant may be added to the extruder barrel 7 via injection line 12 from supply source 13.

After air drying, all the samples were cut in the laboratory to a standard 70 mm or 100 mm length, weighed and circumference tested using a Borgwaldt laser circumference gauge. Pressure drop was tested on a BAT servo mechanical pressure drop tester. Firmness was also determined by using the standard Borgwaldt filter firmness tester. It was found that, for extrudate which had physical dimensions greater than the largest dimensions capable of being measured in conventional testing machines, it was difficult to determine accurate measurements therefor.

EXAMPLE 1

Using the above formulation, several runs were made with various screw speeds and water feed rates in order to determine the effect on rod pressure drop. The results are illustrated in Tables 1 and 2. It can be seen, especially with the Hylon (a high amylose content starch; National Starch and Chemical Company) runs, that increasing screw speed tends to increase the rod pressure drop. Reducing the water feed rate also increases the rod pressure drop.

The pressure drop range from extruded rods of filtration material according to the present invention extends above and below the range achievable with cellulose acetate tow.

TABLE 1

| Run No. | | 15/1/06 | 15/1/03 | 15/1/07 | 15/1/08 | 14/2/01 | 14/2/04 | 14/2/05 |
|---|---|---|---|---|---|---|---|---|
| Starch Type | | Maize | Maize | Maize | Maize | Hylon 7 | Hylon 7 | Hylon 7 |
| Feed | (KG/HR) | 12 | 12 | 12 | 12 | 19 | 19 | 19 |
| Water | (KG/HR) | 2.75 | 2.75 | 2.75 | 2.75 | 2.75 | 2.75 | 2.75 |
| Screw Speed | (RPM) | 350 | 406 | 450 | 500 | 406 | 500 | 550 |
| Barrel Temps | (Deg C.) | 85–115 | 85–115 | 85–115 | 85–115 | 85–115 | 85–115 | 85–115 |
| Die Size | (mm) | 4 | 4 | 4 | 4 | 5 | 5 | 5 |
| Back Pressure | (Bars) | 20 | 20 | 18 | 18 | 32 | 30 | 32 |
| Product Diameter ex Die | (mm) | 8.40 | 8.60 | 7.60 | 7.20 | 8.50 | 8.50 | 8.40 |
| Moisture content ex Die | (%) | 19.6 | 19.4 | 19.3. | 19.1 | 13.4 | 13.2 | 13.5 |
| Cooled Product diamter | (mm) | 21.81 | 22.64 | 21.27 | 20.75 | 24.73 | 24..36 | 24.91 |
| Weight of 70 mm Rod | (mg) | 790.00 | 782.00 | 721.00 | 736.00 | 1182.00 | 1123.00 | 1140.00 |
| P.D. of 70 mm Rod | (mm WG) | Small | 62.00 | Small | Small | 296.00 | 338.00 | 618.00 |
| Circumference | (mm) | 21.81 | 22.64 | 21.27 | 20.78 | 24.73 | 24.36 | 24.91 |
| Density of Cooled Product | (mg/cc) | 298 | 273 | 286 | 306 | 346 | 339 | 329 |

Small - pressure drop measurement too small to register on pressure drop tester.

TABLE 2

| Run No. | | 5/2/05 | 5/2/04 | 5/2/03 | 5/2/01 | 5/2/02 | 14/2/03 | 14/2/01 | 14/2/02 |
|---|---|---|---|---|---|---|---|---|---|
| Starch Type | | Maize | Maize | Maize | Maize | Maize | Hylon 7 | Hylon 7 | Hylon 7 |
| Feed | (KG/HR) | 20.4 | 20.4 | 20.4 | 20.4 | 20.4 | 19.0 | 19.0 | 19.0 |
| Water | (KG/HR) | 2.10 | 2.25 | 2.40 | 2.75 | 3.25 | 2.25 | 2.75 | 3.25 |
| Screw Speed | (RPM) | 412 | 411 | 411 | 406 | 409 | 408 | 406 | 407 |
| Barrel Temps | (Deg C.) | 85–115 | 85–115 | 85–115 | 85–115 | 85–115 | 85–115 | 85–115 | 85–115 |
| Die Size | (mm) | 5 | 5 | 5 | 5 | 5 | 5 | 5 | 5 |
| Back Pressure | (Bars) | 36 | 34 | 31 | 26 | 23 | 39 | 32 | 27 |
| Product Diameter ex Die | (mm) | 9.6 | 9.0 | 9.0 | 9.4 | 9.9 | 9.0 | 8.5 | 8.9 |
| Moisture content ex Die | (%) | 12.4 | 13.7 | 13.8 | 14.7 | 17.7 | 11.9 | 13.4 | 15.5 |
| Cooled Product Diameter | (mm) | 23.78 | 24.85 | 26.10 | 25.80 | 25.58 | 23.69 | 24.73 | 24.71 |

TABLE 2-continued

| Run No. | | 5/2/05 | 5/2/04 | 5/2/03 | 5/2/01 | 5/2/02 | 14/2/03 | 14/2/01 | 14/2/02 |
|---|---|---|---|---|---|---|---|---|---|
| Weight of 70 mm Rod | (mg) | 1167 | 1231 | 1239 | 1104 | 1124 | 1219 | 1182 | 1153 |
| Density of cooled product | (mg/cc) | 371 | 358 | 327 | 305 | 30& | 390 | 347 | 339 |
| P.D. of 70 mm Rod | (mm WG) | 644 | 242 | 142 | 77 | 86 | 2000 | 296 | 191 |
| Circumference | (mm) | 23.78 | 24.85 | 26.10 | 25.80 | 25&58 | 23.69 | 24.73 | 24.71 |

EXAMPLE 2

A number of products from various runs were tested and their firmness noted. Conventional cellulose acetate tow filters have mean firmness values in the range of 77%–88%. From the data below it can be seen that the firmness of rods according to the present invention are in the order of at least about 10% greater than the firmness of conventional cellulose acetate filters.

| Experiment | A | B | C | D | E | F | G |
|---|---|---|---|---|---|---|---|
| Mean Firmness (%) | 95.9 | 94.0 | 96.3 | 96.0 | 95.4 | 95.8 | 95.4 |

EXAMPLE 3

In order to assess the effects of a number of different operating parameters on the formulation, or blend, fed to the extruder a factorial experimental protocol was designed for the blend described above, i.e. a blend comprising 80% cellulose acetate flake, 15% maize starch and 5% hydroxy propyl cellulose. The factorial design is outlined in Table 3 below. The physical characteristics of the final product were determined using cut 100 mm lengths of extrudate.

Statistical analysis of this data shows that increasing the screw speed increases the rod pressure drop and reducing the water feed rate also increases the rod pressure drop. Increasing the die size tends overall to decrease the rod pressure drop.

EXAMPLE 4

A number of formulations were extruded through the extruder under the same operating conditions. The extruder had a die orifice of 4 mm, a water feed rate of 2.1 liters/hour, a screw speed of 500 rpm and a feed rate of 15 kg/hour. Table 4 below outlines the formulations used and the measured physical characteristics of the final product.

TABLE 3

| FACTORIAL | FEED RATE (kg/hr) | WATER FEED (l/hr) | SCREW SPEED (rpm) | DIE SIZE (mm) | CIRC. (mm) | DENSITY (mg/cc) | WEIGHT (g) | PRESSURE DROP (mm WG) (100 mm length) |
|---|---|---|---|---|---|---|---|---|
| 1 | 12.5 | 1.6 | 400 | 4 | 24.36 | 300 | 1.42 | 5084* |
| 2 | 15.0 | 1.6 | 400 | 4 | 25.77 | 269 | 1.43 | 5270* |
| 3 | 12.5 | 2.1 | 400 | 4 | 21.60 | 328 | 1.22 | 590 |
| 4 | 15.0 | 2.1 | 400 | 4 | 23.99 | 289 | 1.33 | 1096* |
| 5 | 12.5 | 1.6 | 500 | 4 | 26.13 | 266 | 1.44 | 5400 |
| 6 | 15.0 | 1.6 | 500 | 4 | 27.96 | 243 | 1.51 | 6600 |
| 7 | 12.5 | 2.1 | 500 | 4 | 22.63 | 297 | 1.21 | 295 |
| 8 | 15.0 | 2.1 | 500 | 4 | 25.31 | 253 | 1.29 | 941 |
| 9 | 12.5 | 1.6 | 400 | 4.5 | 25.55 | 273 | 1.58 | 997 |
| 10 | 15.0 | 1.6 | 400 | 4.5 | 26.93 | 304 | 1.56 | 3272* |
| 11 | 12.5 | 2.1 | 400 | 4.5 | 24.57 | 323 | 1.55 | 155 |
| 12 | 15.0 | 2.1 | 400 | 4.5 | 25.81 | 286 | 1.51 | 174 |
| 13 | 12.5 | 1.6 | 500 | 4.5 | 27.33 | 276 | 1.64 | 1384* |
| 14 | 15.0 | 1.6 | 500 | 4.5 | 29.07 | 244 | 1.64 | 5512* |
| 15 | 12.5 | 2.1 | 500 | 4.5 | 23.70 | 306 | 1.37 | 191 |
| 16 | 15.0 | 2.1 | 500 | 4.5 | 26.12 | 265 | 1.44 | 153 |

*Smaller lengths measured then scaled up to 100 mm.

TABLE 4

| | CA Flake (%) | Maize Starch (%) | HPC (%) | CIRCUMFERENCE (mm) | DENSITY (mg/cc) | FIRMNESS (%) | PRESSURE DROP (mm WG) |
|---|---|---|---|---|---|---|---|
| | 74 | 20 | 6 | 24.48 | 224 | 94.1 | 117 |
| | 69 | 25 | 6 | 23.21 | 197 | 90.1 | 158 |
| | 64 | 30 | 6 | 22.00 | 221 | 91.9 | 236 |
| $ | 71 | 20 | 9 | 26.38 | 169 | 89.3 | 105 |
| | 66 | 25 | 9 | 23.62 | 190 | 89.8 | 192 |
| # | 61 | 30 | 9 | 20.62 | 215 | 87.5 | 84 |
| | 68 | 20 | 12 | 22.98 | 187 | 86.1 | 142 |
| + | 63 | 25 | 12 | 22.24 | 198 | 86.0 | 199 |
| * | 58 | 30 | 12 | 19.62 | 232 | 87.4 | 168 |

Figure 4A:
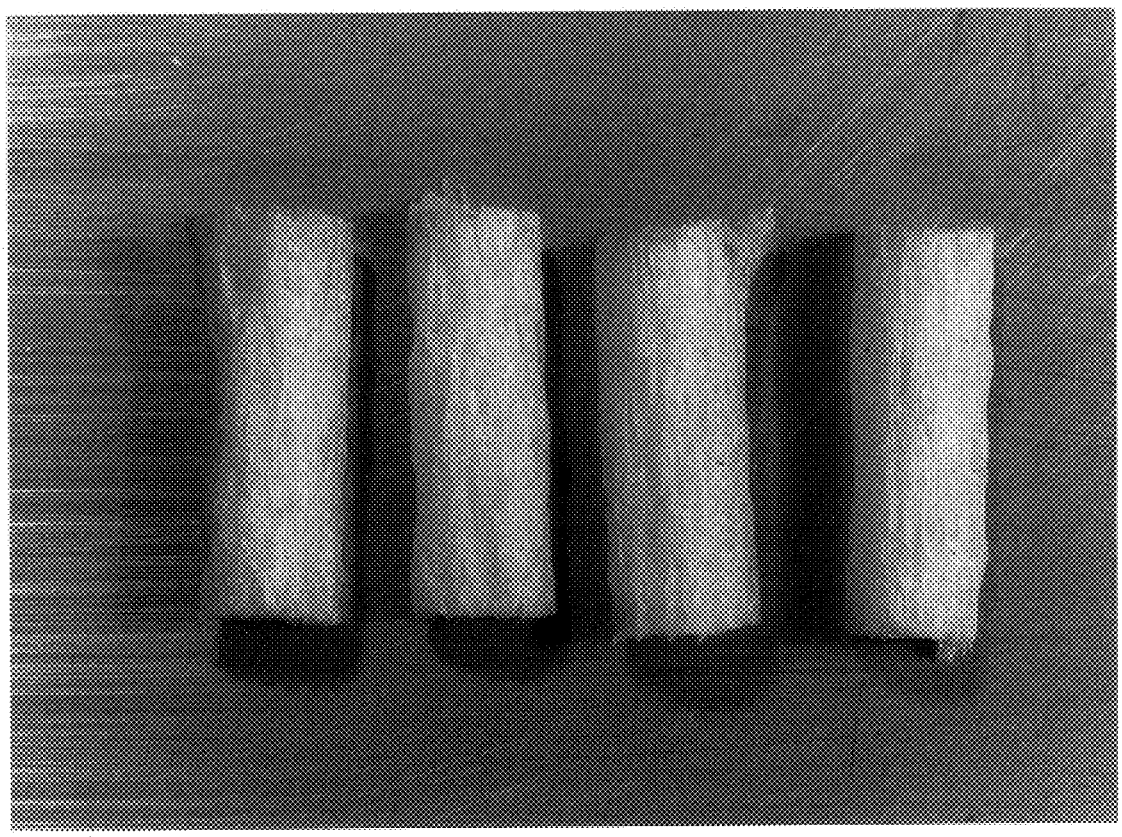
FIGS. 4*a*, 4*b*, 5*a*, 5*b*, 6*a*, 6*b*, 7*a* and 7*b* show filter elements according to the invention before and after being subjected to the accelerated weathering cycle.
Figure 4B:
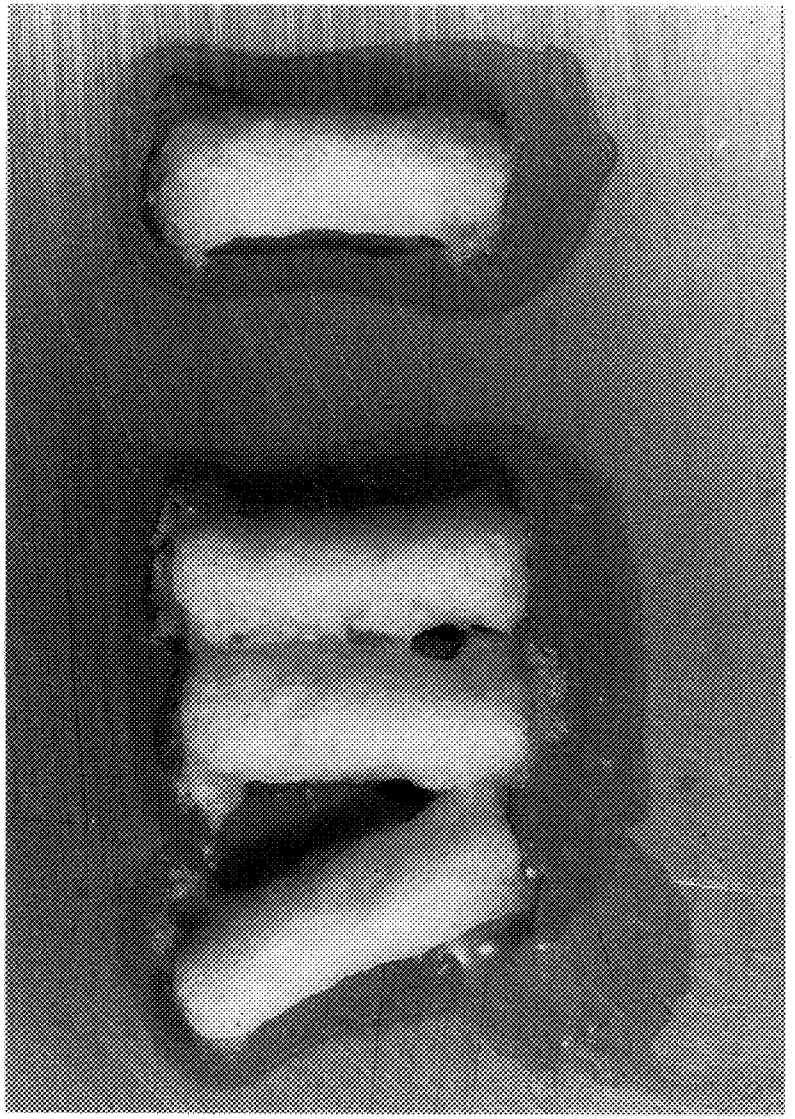
Figure 5A:
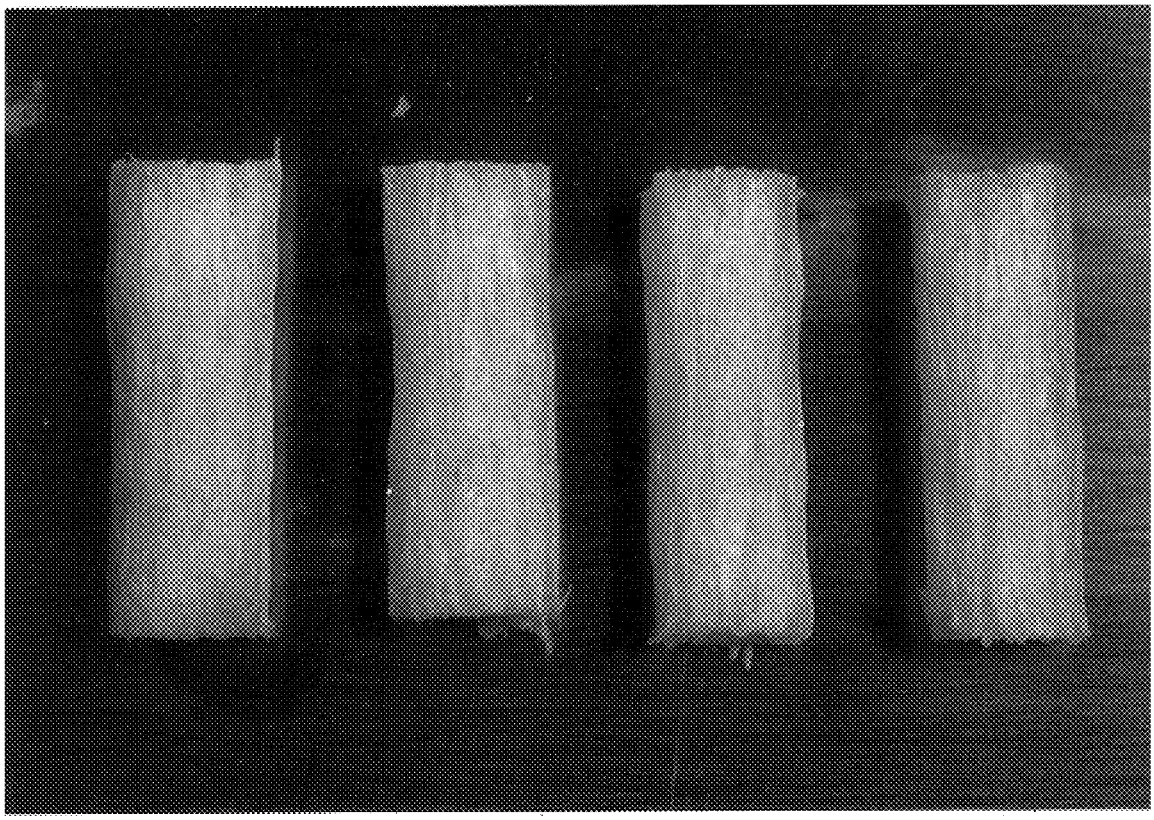
Figure 5B:
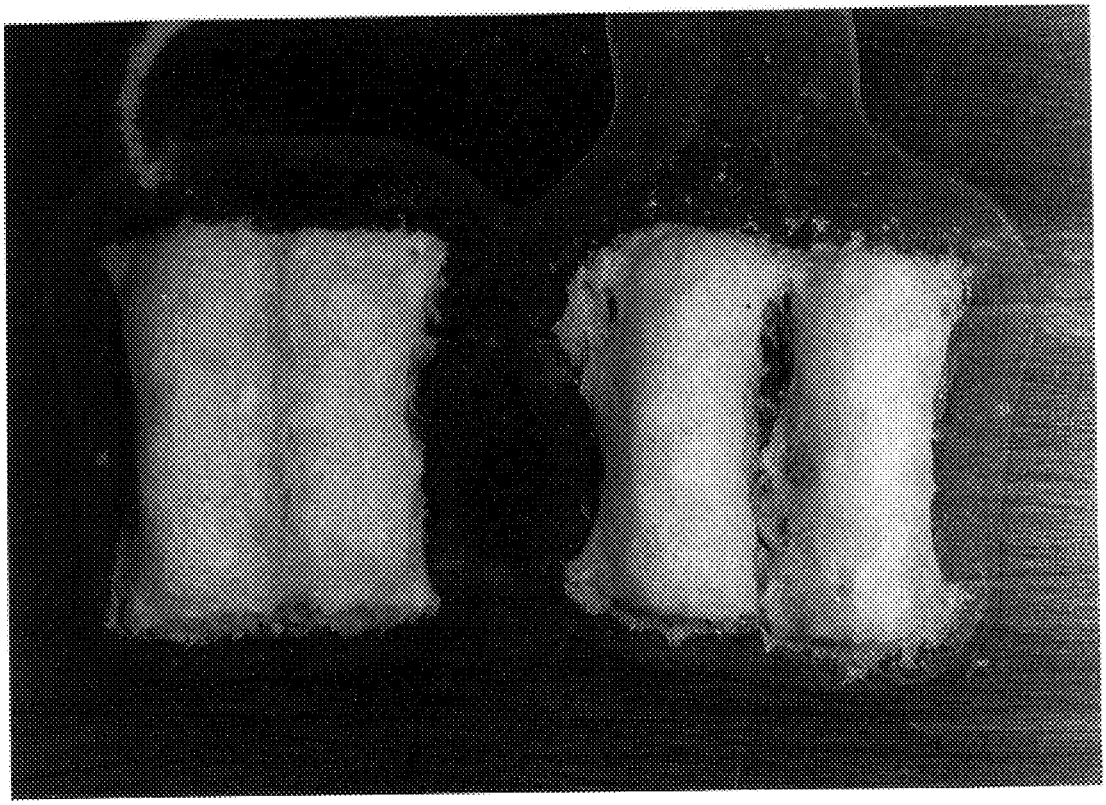
Figure 6A:
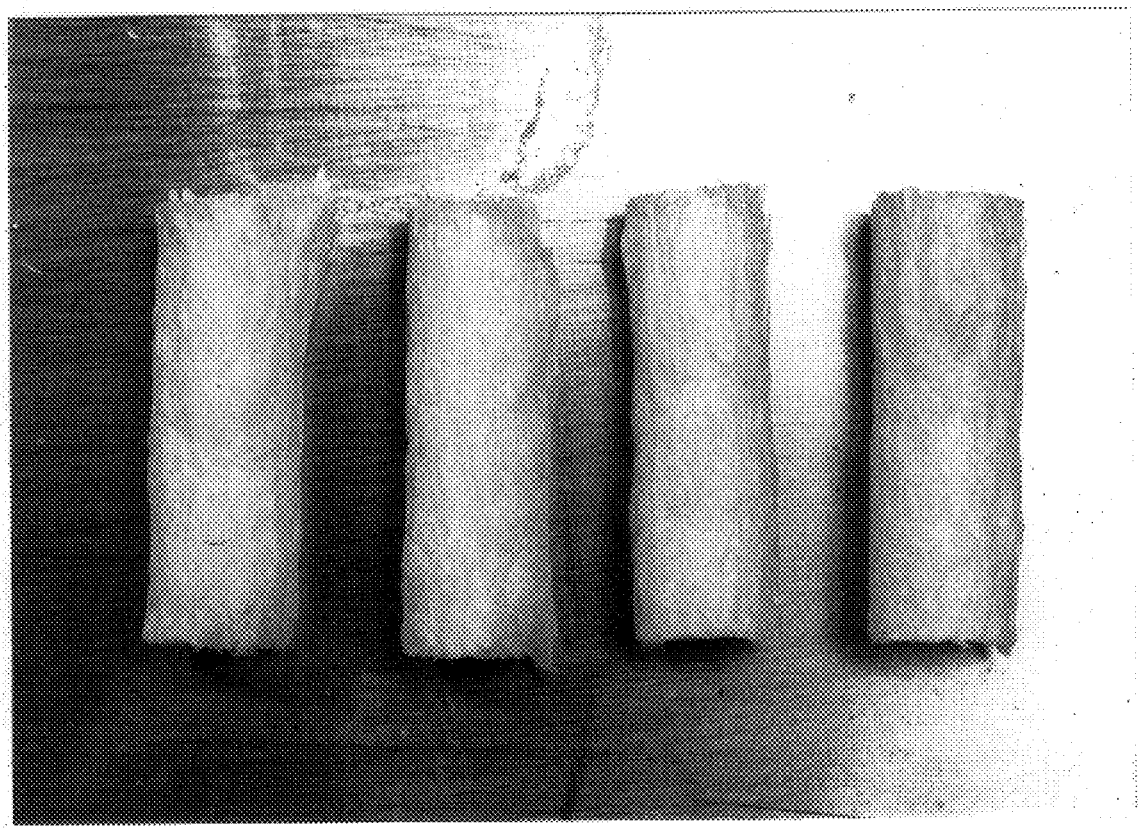
Figure 6B:
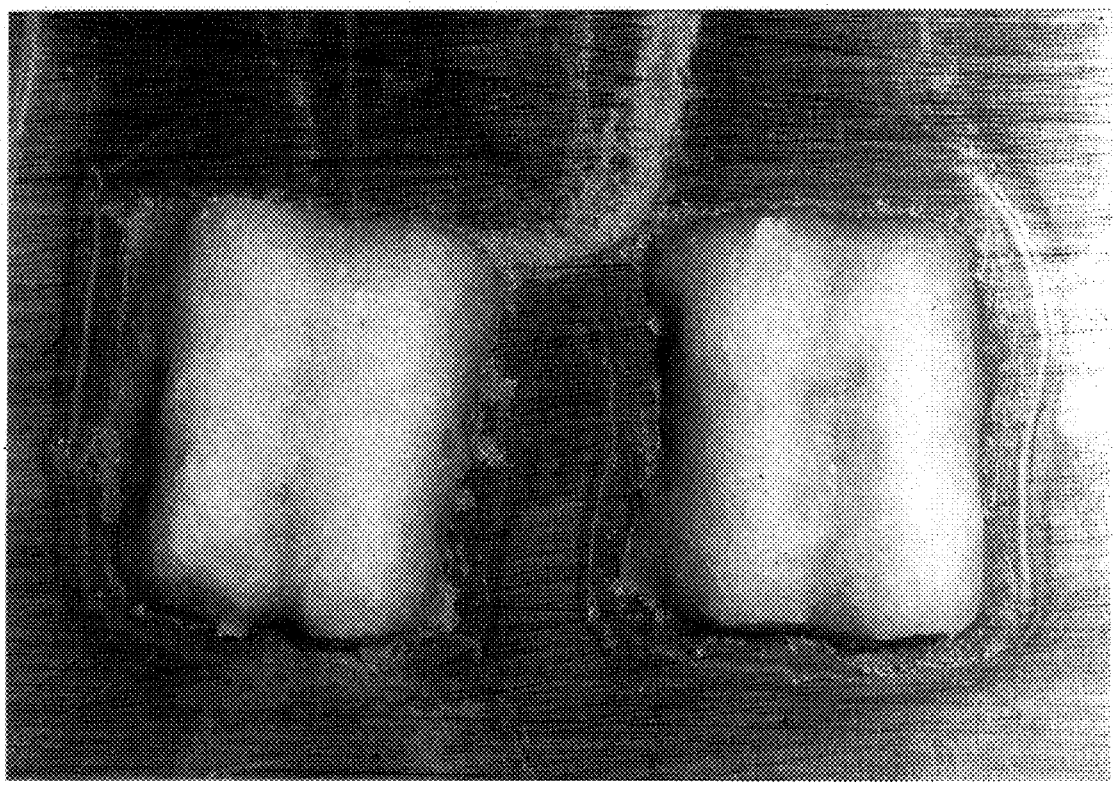
Figure 7A:
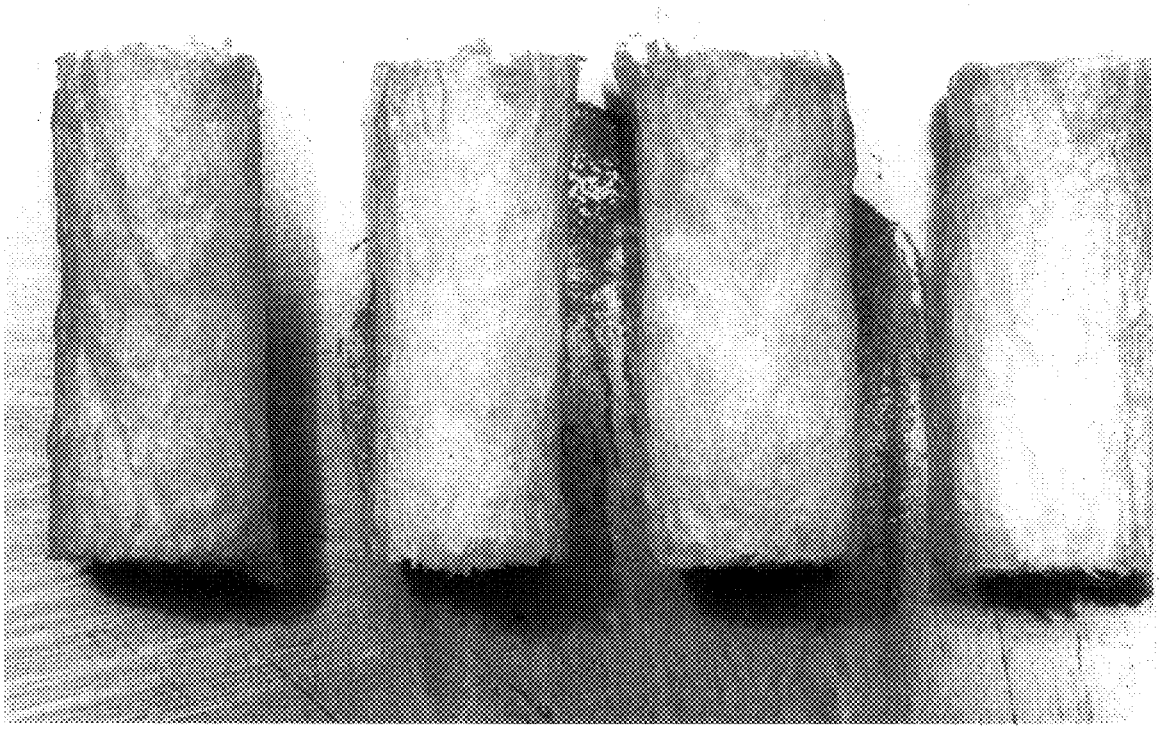
Figure 7B:
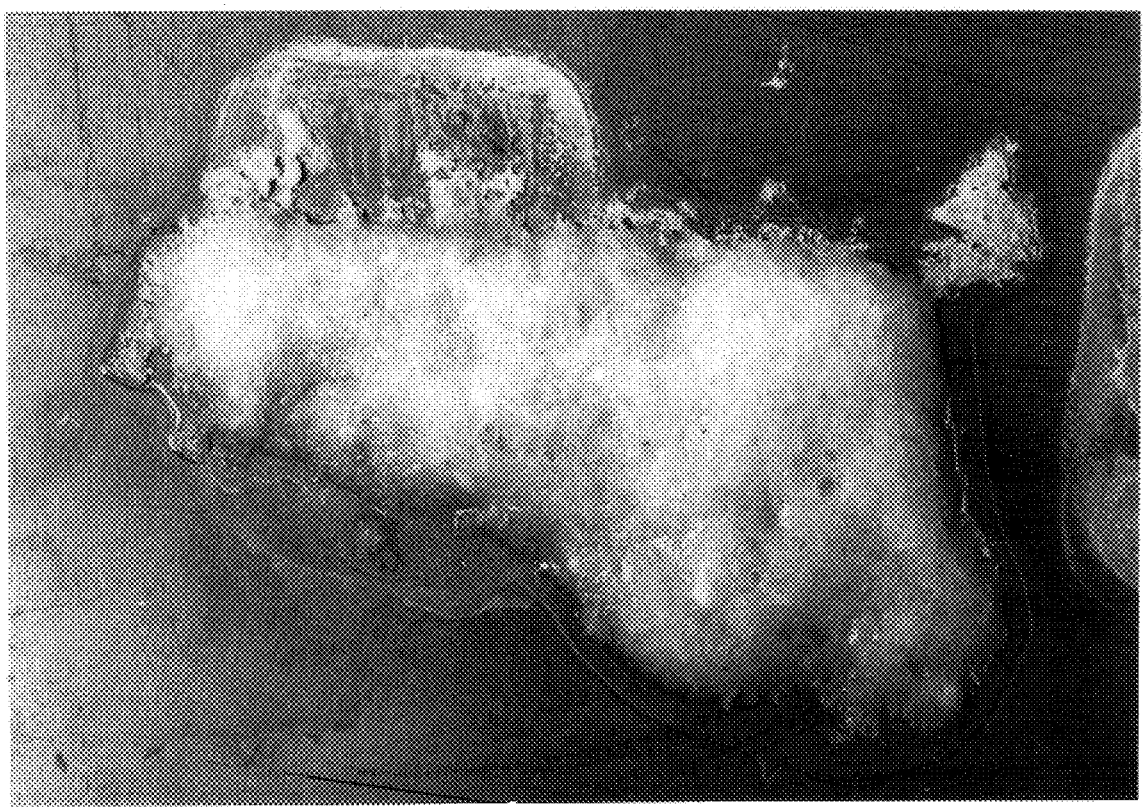

CA = cellulose acetate
HPC = hydroxypropyl cellulose
Pressure drop measurements taken for 100 mm lengths
* FIG. 4
+ FIG. 5
FIG. 6
$ FIG. 7

It may be seen that the firmness of some of the rods of these examples can be brought down into or towards the firmness range of conventional cellulose acetate filter rods. It is therefore possible to produce degradable filter rods at a firmness which is comparable to that currently experienced by the consumer of filter-tipped cigarettes. Furthermore, the extruded final product circumference, density and pressure drop are also obtainable within conventional limits for these parameters.

EXAMPLE 5

A number of formulations using a different polysaccharide expansion medium from that described in Example 4 were extruded through the extruder under the following operating conditions: die orifice 4.5 mm, feed rate of 16.2 kg/hr to give a final product weight of 270 g for a sample extruded over 1 minute, and screw speed 500 rpm. Table 5 outlines the formulations used and the measured physical characteristics of the final product.

TABLE 5

| CA flake (%) | Eco foam starch (%) | HPC (%) | Water (l/hr) | Circumference (mm) | Density (mg/cc) | Firmness (%) | Pressure Drop (mm WG) |
|---|---|---|---|---|---|---|---|
| 80 | 15 | 5 | 2.10 | 27.05 | 264 | 95.8 | b |
| 80 | 15 | 5 | 1.75 | 28.12 | 257 | 95.3 | — |
| 77 | 15 | 8 | 2.10 | 27.15 | 200 | 89.2 | 119 |
| 77 | 15 | 8 | 1.75 | 31.14 | 162 | — | b |
| 70 | 25 | 5 | 2.10 | 25.22 | 245 | 92.6 | — |
| 70 | 25 | 5 | 1.75 | 28.95 | 207 | 92.7 | 1543 |
| 83 | 15 | 2 | 2.10 | 19.18 | 555 | 99.3 | s |
| 83 | 15 | 2 | 1.75 | 20.96 | 482 | 98.2 | v |
| 90 | 5 | 5 | 2.10 | 17.61 | 649 | 97.0 | s |
| 90 | 5 | 5 | 1.75 | 19.98 | 542 | 96.1 | s |

b = too big to measure
v = variable
— = not measured
s = too small to measure

EXAMPLE 6

Cigarettes were made by hand by assembling a 20 mm filter length with a 64 mm Virginia tobacco rod length. The filter elements used were selected from the extrudate of Examples 1 and 2. These cigarettes were smoked under standard machine smoking conditions, namely a 35 $cm^3$ puff of 2 seconds duration was taken every minute, to filter plus 8 mm butt length. Five cigarettes were smoked for each type. The deliveries and filtration efficiencies, together with theoretical efficiencies for mono cellulose acetate tow filters of equivalent lengths and pressure drop, are given in Table 6 below.

The pressure drop of the filters were measured by three methods (A, B, C) to illustrate the difference in readings. These pressure drop differences are probably caused by different levels of incomplete sealing around the irregular surface of the filter exterior, either when in the test head of the pressure drop meter or when attached by tipping paper to a tobacco rod. The expected filtration efficiencies for mono cellulose acetate filters were calculated using the mean pressure drop from these three readings. The efficiencies calculated for the highest pressure drop are purely theoretical, as a conventional cellulose acetate filter having such a high pressure drop does not exist within present manufacturing tolerances.

TABLE 6

| EXPERIMENT NUMBER | | 5/2/01 | 5/2/03 | 5/2/04 | 5/2/05 | 14/2/05 | 5/2/05 |
|---|---|---|---|---|---|---|---|
| Weight of filter | (mg) | 315 | 354 | 352 | 332 | 323 | 332 |
| Circumference | (mm) | 25.8 | 26.1 | 24.85 | 23.8 | 24.9 | 23.8 |
| Density | (mg $cm^{-3}$ | 297 | 326 | 358 | 368 | 336 | 368 |
| Filter p.d. (mm Water Gauge) | -A | 18 | 32 | 55 | 93 | 145 | 93 |
| | -B | 28 | 47 | 74 | 116 | 166 | 116 |
| | -C | 22 | 41 | 69 | 114 | 160 | 114 |
| Filter Ventilation | (%) | 0 | 0 | 0 | 0 | 0 | 37 |
| Deliveries (mg $cig^{-1}$) | -Tar | 27.3 | 28.4 | 30.1 | 29.3 | 17.2 | 18.7 |
| | -Nicotine | 2.03 | 2.04 | 2.06 | 2.04 | 1.44 | 1.72 |
| | -Water | 2.79 | 3.04 | 4.01 | 4.13 | 1.42 | 0.93 |
| | -PMWNF | 22.5 | 23.3 | 24.0 | 23.1 | 14.3 | 16.0 |
| | -Puff No | 8.2 | 8 | 8 | 8.4 | 8.2 | 8.9 |
| Filtration Efficiencies (%) | -Tar | 32.1 | 29.5 | 25.2 | 27.1 | 57.3 | 36.2* |
| | -Nicotine | 17.1 | 16.7 | 15.9 | 16.7 | 41.2 | 15.7* |
| | -Water | 64.6 | 61.5 | 49.2 | 47.7 | 82.0 | 77.5* |
| | -PMWNF | 24.8 | 22.0 | 19.6 | 22.5 | 52.1 | 30.7* |
| Expected Efficiencies for Mono CA (%) | -Tar | 24 | 33 | 44 | 52 | 58 | |
| | -Nicotine | 18 | 26 | 35 | 39 | 43 | |

A = Filter pressure drop determined by total cigarette minus tobacco rod pressure drop.
B = Measured pressure drop of 20 mm filters.
C = Filter pressure drop calculated from filter rod (70 mm length) pressure drop.
*Reductions due to ventilation.

It may be noted that the filtration efficiencies for the experimental filters show a different response to increasing pressure drop than the expected filtration efficiencies for the mono cellulose acetate filters of conventional construction. The filtration efficiencies of rods according to the invention remain effectively constant over the pressure drop range of 30–120 mm WG. In contrast, conventional filters show an increase in filtration efficiency as pressure drop increases.

The pressure drop and efficiencies of a conventional cellulose acetate filter are directly related to the total surface area of the fibre used in filter construction. The difference in efficiencies of filters according to the invention and conventional cellulose acetate tow filters suggests that there is a different physical structure in filters according to the invention.

The similarity of filtration efficiency of filters according to the invention may be of use to a cigarette designer. For example, for filter rods of 20 mm length and having a pressure drop in the range of 20–120 mm WG which have an effectively constant filtration efficiency, the filtration efficiency of said filter rods could, perhaps, be varied by increasing or decreasing the length of the filter rod.

Ventilation may also be used to alter the filter pressure drop and smoke deliveries. The invention allows for the production of filter elements having higher pressure drops but lower filtration efficiencies than a conventional cellulose acetate tow filter of the same length. Ventilation of a filter element produced according to the invention will lower the pressure drop but also increase the overall reduction of some of the mainstream smoke deliveries such that the pressure drop and deliveries of a filter element produced according to the invention will equate to those seen with the cellulose acetate filter in a similar cigarette design. However, smoke components that are normally unaffected by filtration (e.g. gases such as carbon monoxide, vapour phase components, etc.) will be reduced by said ventilation.

It is believed that much larger extrudate diameters could be obtained by varying the operative conditions of the extruder. However, extrudate parameters such as diameter which are much larger than conventional diameters are difficult to measure in conventional testing equipment.

EXAMPLE 7

Figure 2A:
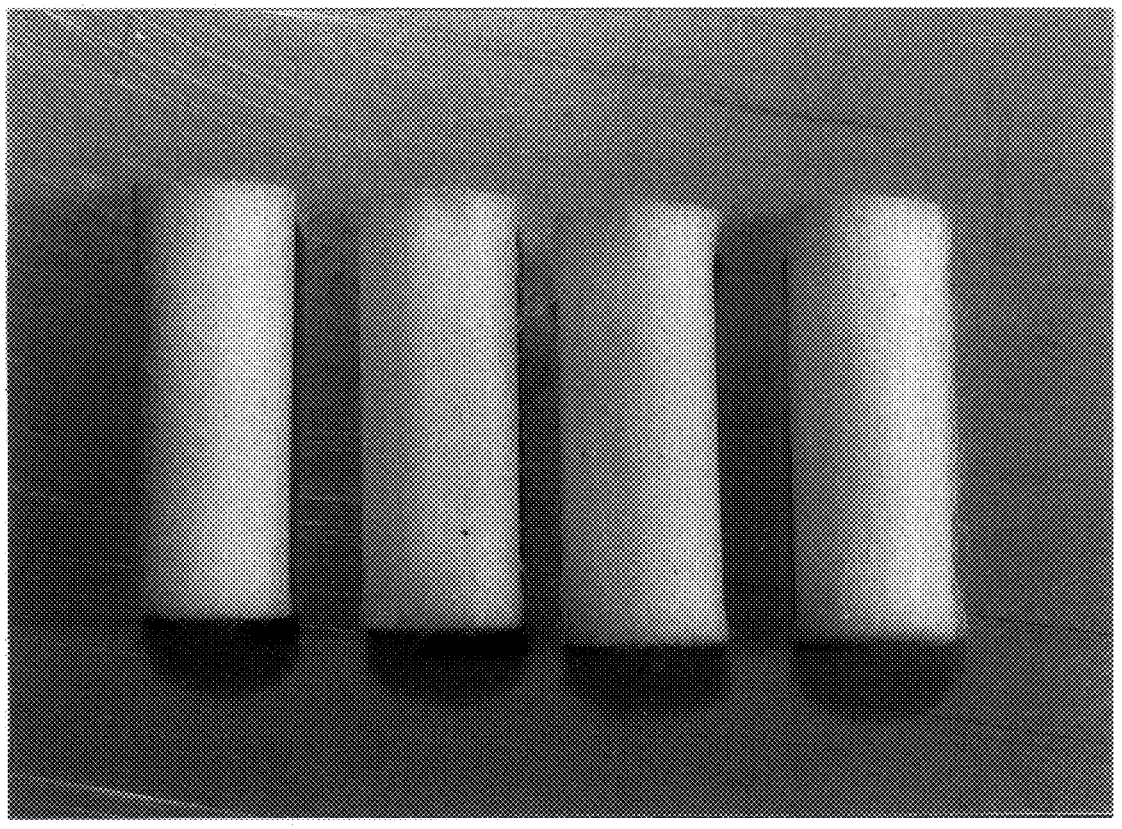
FIG. 2*a* shows conventional cellulose acetate filter elements before being subjected to simulated weather conditions of the natural environment.
Figure 2B:
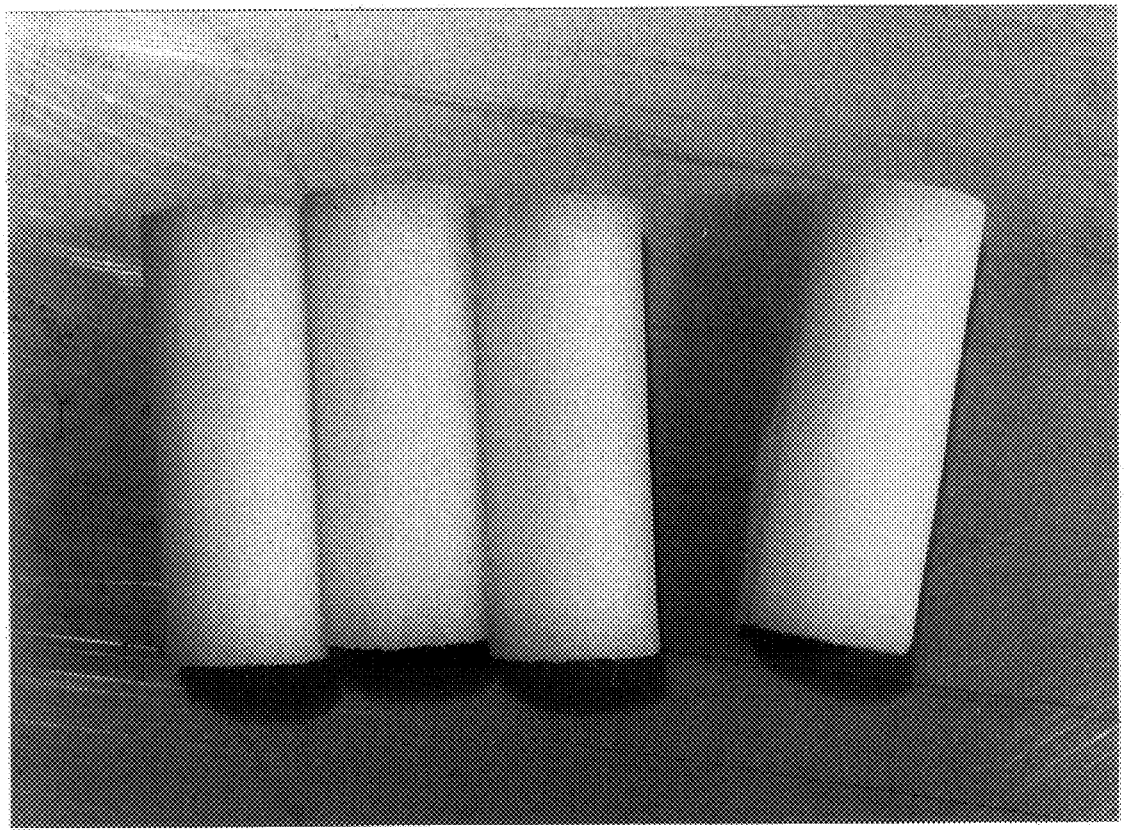
FIG. 2*b* shows conventional cellulose acetate filter elements after being subjected to simulated weather conditions of the natural environment.

FIG. 2 shows conventional cellulose acetate filter elements before and after being subjected to simulated weather conditions of the natural environment.

In order to subject these filter elements to conditions simulating the weather conditions of the natural environment, they were placed in the Q.U.V. Weathering Tester for 2 hours and subjected to the weathering cycle described above. Two hours exposure in the Weathering Tester is roughly equivalent to 24 hours exposure to the weather conditions of the natural environment.

Figure 3A:
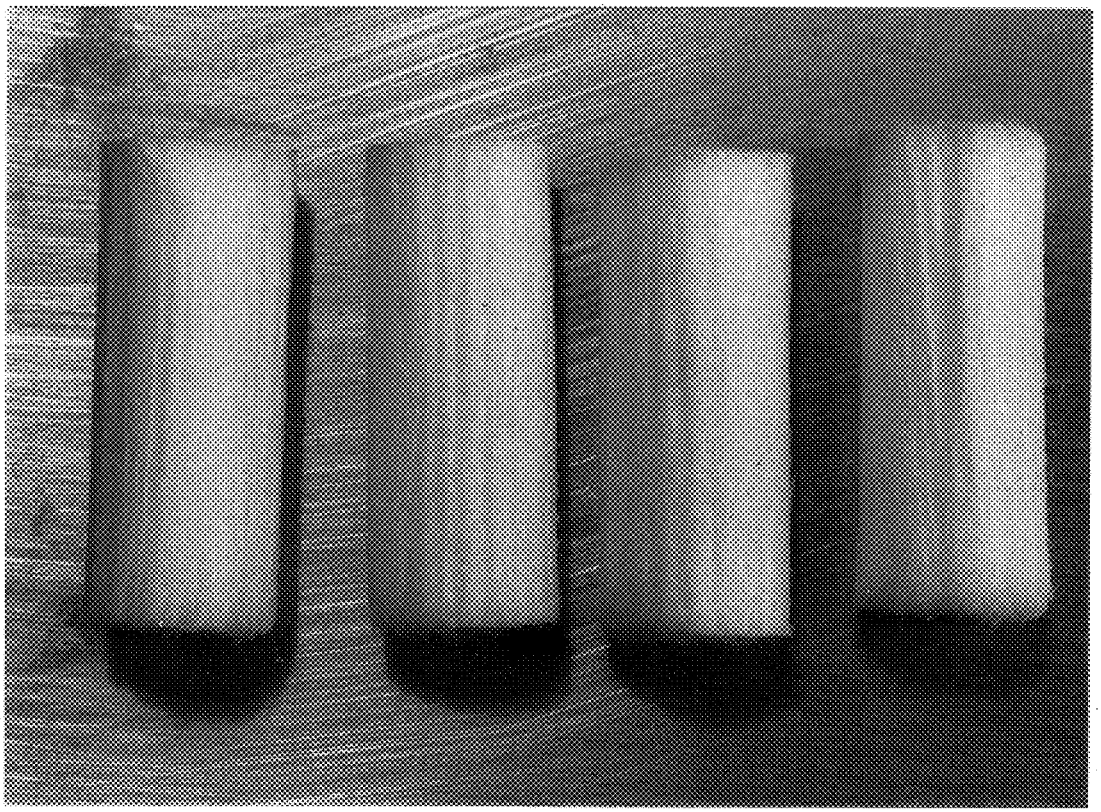
FIG. 3*a* shows conventional paper filter elements before being subjected to simulated weather conditions of the natural environment.
Figure 3B:
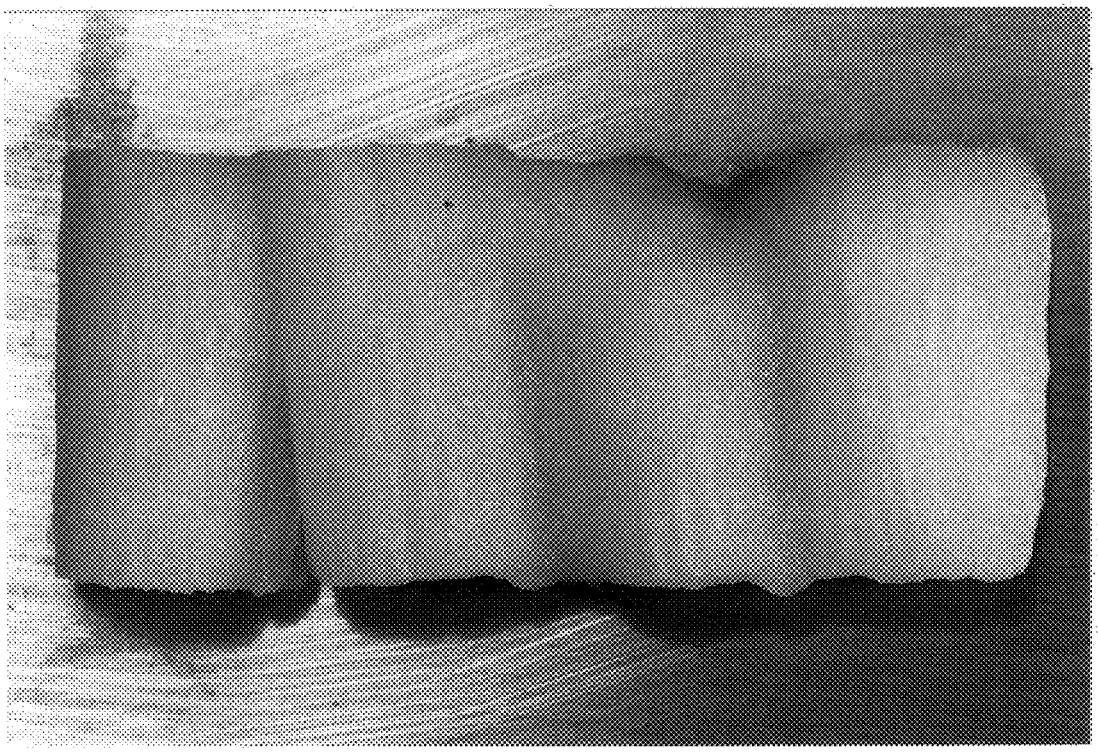
FIG. 3*b* shows conventional paper filter elements after being subjected to simulated weather conditions of the natural environment.

FIG. 3 shows paper filter elements before and after being subjected to the accelerated weathering cycle. FIGS. 4*a,* 4*b,* 5*a,* 5*b,* 6*a,* 6*b,* 7*a* and 7*b* show filter elements according to the invention before and after being subjected to the accelerated weathering cycle. It is clear from these samples that the filter elements of the present invention are already exhibiting significant disintegration. In contrast, the conventional cellulose acetate and paper filter elements show very little after-effects of the weathering conditions.

EXAMPLE 6

A run was conducted using a formulation comprising 65% cellulose acetate flake, 24% maize starch and 11% hydroxypropylcellulose, the feed rate being 8.86 Kg/hr. Glycerol was fed to the barrel at 1.14 l/hr. The screw speed of the extruder was 400 rpm. The temperature profile along the barrel was 65° C., 85° C. and 115° C. for the second, third and fourth sections respectively. The extruder die was 6 mm in diameter. The back pressure at the extruder die was about 1 bar (this measurement at low pressures varies from 0–5 bars in accuracy). The throughput of the extruder was 9.36 kg/hr.

Upon extrusion the product had the following physical characteristics:

| | | |
|---|---|---|
| Diameter | 14.4 | mm |
| Weight | 1283 | mg/70 mm length |
| Circumference | 24.97 | mm |
| Pressure Drop | 1078 | mm WG/70 mm length |
| Firmness | 89.3% | (Borgwaldt measurement) |
| Moisture content (ex-die) | 9.8% | |
| Glycerol content (ex-die) | 5.0% | |

EXAMPLE 9

A number of formulations were extruded to determine the effect of removal of the plastics material from the formulation, thus further enhancing the degradability of the product to natural components. The extruder had the following operating conditions: die orifice 6 mm circular and screw speed 400–420 rpm. Below are the run numbers and formulations.

| Run Number | Extrudate Mix |
|---|---|
| 15/2/03 | 100% Hydroxypropylamylose |
| 15/2/04 | 100% Hydroxypropylamylose |

-continued

| Run Number | Extrudate Mix |
|---|---|
| 16/2/01 | 50% Hydroxypropylamylose<br>50% Pectin |
| 16/2/02 | 50% Hydroxypropylamylose<br>50% Pectin |
| 16/2/03 | 70% Hydroxypropylamylose<br>30% Propylene glycol alginate |
| 16/2/04 | 70% Hydroxypropylamylose<br>30% Propylene glycol alginate |
| 18/2/01 | 60% Maize Starch<br>40% Hydroxyethylcellulose |
| 18/2/02 | 60% Maize Starch<br>40% Hydroxyethylcellulose |

For the run numbers 15/2/03 and 15/2/04 the barrel temperatures in the second, third and fourth sections were 55° C., 75° C., 105° C. For the remainder of the runs the barrel temperatures were 65° C., 85° C. and 115° C.

Table 7 outlines the operating conditions and physical characteristics measured.

The water feed to the extruder, when used alone, was with the range of about 29–45%. When glycerol was fed to the extruder in addition, the water was 7–22% of the total material, including water, fed to the extruder.

It should be noted that the firmness figures are probably lower than actual as we experienced difficulty in making the measurements because of the smaller diameter than normal of the rods. The screw configuration for these samples was different from the screw configuration used for the previous examples.

TABLE 7

| Run No. | | 15/2/03 | 15/2/04 | 16/2/01 | 16/2/02 | 16/2/03 | 16/2/04 | 18/2/01 | 18/2/02 |
|---|---|---|---|---|---|---|---|---|---|
| Water Feed | (1/hr) | 1.02 | 1.68 | 1.5 | 2.7 | 0.6 | 2.1 | 1.2 | 2.7 |
| Glycerol feed | (l/hr) | 0.9 | — | 1.2 | — | 0.9 | — | 1.2 | — |
| Back pressure | (bars) | 3 | 1 | 1 | — | 6 | 1 | 5 | 6 |
| Extrudate diameter | (mm) | 12.5 | 13.2 | 9.7 | 10.7 | 10.4 | NM | 19.2 | NM |
| Circumference | (mm) | 24.65 | 26.34 | 23.00 | 24.88 | 24.34 | 22.49 | 25.24 | 24.58 |
| Density | (mg/cc) | 476 | 356 | 549 | 428 | 545 | 543 | 447 | 458 |
| Weight | (mg/85 mm) | 1982 | 1682 | 1984 | 1801 | 2181 | 1850 | 1907 | 1880 |
| Pressure Drop* | mm/WG 100 mm | 1455 | 174 | 2894 | 1718 | 5353 | 1138 | 600 | 993 |
| Firmness (Borwaldt) | (%) | 90 | 91 | 88 | 91 | 88 | 85 | 91 | 91 |
| Moisture Exit Die | (5) | 19.8 | 26.4 | 26.2 | 34.3 | 18.4 | 28.5 | 18.9 | 30.2 |
| Glycerol Exit Die | (% dwb) | 9.9 | — | 16.5 | — | 13.5 | — | 13.5 | — |

*scaled up to 100 mm from 85 mm length
NM - not measured
dwb - dry weight basis

EXAMPLE 10

A series of runs were carried out with inorganic fillers using a Baker Perkins MPF 50 extruder. The barrel temperature along the five sections leading towards the die end section were 50° C., 65° C., 75° C., 85° C. and 95° C., respectively.

Each blend used the basic formulation, on an approximate dry weight basis, of 65% inorganic filler, 10% starch, 20% binder consisting of 12% hydroxypropylcellulose and 8% carboxymethylcellulose, and 5% glycerol. Water was further supplied to the extruder barrel. In some runs the inorganic filler comprised a mixture of materials. Details of the inorganic fillers and the physical characteristics of the extruded products are given in Table 8 below.

TABLE 8

| Inorganic Filler (% dry weight basis) | Filter Characteristics | | | | | Screw Speed (rpm) |
|---|---|---|---|---|---|---|
| | Length (mm) | Weight (mg) | Circumference (mm) | Pressure Drop (mm W.G.) | Die Size (mm) | |
| 65% Aluminium hydroxide | 70.45 | 1826 | 20.6 | 195 | 4.0 | 225 |
| 32.5% Aluminium hydroxide 32.5% Aluminium oxide | 70.2 | 994 | 23.48 | 88 | 4.0 | 225 |
| 49% Aluminium hydroxide 16% Aluminium oxide | 70.45 | 1493 | 24.3 | 126 | 4.5 | 225 |
| Metaspheres 50 | 99.7 | 2730 | 24.18 | 579 | 6.5 | 225 |
| Garolite | 99.9 | 2460 | 24.29 | 309 | 6.5 | 225 |
| Verniculite | 99.9 | 3410 | 24.91 | 194 | 6.5 | 230 |
| Trihyde | 101.8 | 6400 | 23.83 | NM | 9.0 | 270 |

EXAMPLE 11

A further series of runs was carried out on the same extruder and under the same barrel conditions as Example 10, using chalk and carbon as detailed below:

| Material | Weight (% dry weight basis) | | | |
|---|---|---|---|---|
| | Run A | Run B | Run C | Run D |
| Chalk | — | — | 80 | 71 |
| Carbon | 65 | 70 | — | — |
| Starch | 10 | 8 | — | 15 |
| Hydroxypropyl-cellulose | 12 | 12 | 9 | 9 |
| Carboxymethyl-cellulose | 8 | 5 | 6 | — |
| Glycerol | 5 | 5 | 5 | 5 |

Water was further fed to the extruder barrel. The physical characteristcs of the extruded rod are detailed in Table 9 below.

TABLE 9

| Run | Length (mm) | Weight (mg) | Circumference (mm) | Pressure Drop (mm W.G.) | Die Size (mm) | Screw Speed (rpm) |
|---|---|---|---|---|---|---|
| A | 70.2 | 1600 | 24.51 | 231 | — | — |
| B | 69.5 | 1700 | 24.24 | 390 | — | — |
| C | 71.1 | 2660 | 22.48 | NM | 6.5 | 225 |
| D | 69.6 | 1450 | 24.08 | NM | 5.0 | 225 |

We claim:

1. An extruded filtration material, comprising inorganic material, a water-soluble polysaccharide expansion medium, a binder and water, said inorganic material being comprised of one or more of the group consisting of vermiculite, alumina, aluminum hydroxide, carbon, chalk and aluminum silicates, during the extrusion of which extruded filtration material the water or at least a portion thereof vaporizes to steam upon extrusion of the material from the extruder die, the extruded filtration material thereby assuming a cross-section greater than the cross-section of the exit orifice of the extruder die, the inorganic material being selected so that the melting point thereof is above the operating temperature of the extrusion process at any particular operating pressure, and there thereby being imparted to the filtration material a cellular structure which cellular structure provides for the passage of air and/or smoke, the filtration material being degradable and wherein said inorganic filler material comprises 60–85% by weight, said polysaccharide expansion medium comprises 5–20%, by weight, and said binder comprises 5–25% by weight, of dry materials fed to the extruder.

2. An extruded filtration material according to claim 1, wherein plasticiser in an amount of 3–10% is further supplied to said extruder.

* * * * *